US005879210A

United States Patent [19]

Goto et al.

[11] Patent Number: 5,879,210

[45] Date of Patent: Mar. 9, 1999

[54] POWER TRANSFER DEVICE FOR INBOARD/OUTBOARD MOTOR

[75] Inventors: Shigeki Goto, Kariya; Takayoshi Tsuzuki, Toyota; Yoshinori Kawajiri, Kariya, all of Japan

[73] Assignees: Aisin Seiki Kabushiki Kaisha, Kariya; Aisin Ai Co., Ltd., Nishio, both of Japan

[21] Appl. No.: 864,682

[22] Filed: May 28, 1997

[30] Foreign Application Priority Data

May 30, 1996 [JP] Japan ..... 8-136926

[51] Int. Cl.[6] ..... B63H 20/00

[52] U.S. Cl. ..... 440/75; 192/3.63; 192/51

[58] Field of Search ..... 440/75; 192/3.63, 192/51

[56] References Cited

U.S. PATENT DOCUMENTS

| | | | |
|---|---|---|---|
| 3,217,688 | 11/1965 | Warburton, II | 440/75 |
| 3,399,647 | 9/1968 | Alexander, Jr. et al. | 440/75 |
| 3,623,583 | 11/1971 | Shimanckas | 192/51 |
| 4,767,365 | 8/1988 | Nakahama et al. | 192/51 |
| 5,328,396 | 7/1994 | Hayasaka et al. | 440/75 |

FOREIGN PATENT DOCUMENTS 4-143195 5/1992 Japan .

4-185596 7/1992 Japan .

*Primary Examiner*—Sherman Basinger

*Attorney, Agent, or Firm*—Burns, Doane, Swecker & Mathis, LLP

[57] ABSTRACT

A power transfer device for an inboard/outboard motor which includes a propeller unit mounted on the hull of a vessel, the propeller unit including an input shaft for drive connection to an output shaft of the inboard/outboard motor, an intermediate shaft connected to a propeller shaft, a hydraulic clutch provided on the input shaft to establish a drive power train between the input shaft and intermediate shaft when it has been engaged and to disconnect the input shaft from the intermediate shaft when it has been disengaged, and a changeover mechanism of the gear selection type disposed between the input shaft and intermediate shaft for switching over the drive power train from a forward drive to a backward drive or vice versa. The power transfer device is provided with a hydraulic control apparatus for operating the changeover mechanism in shifting operation to switch over the drive power train from the forward drive to the backward drive or vice versa in a condition where the hydraulic clutch is maintained in its disengaged condition and for engaging the hydraulic clutch after the drive power train has been switched over from the forward drive to the backward drive or vice versa.

3 Claims, 5 Drawing Sheets

POWER TRANSFER DEVICE FOR INBOARD/OUTBOARD MOTOR

BACKGROUND OF THE INVENTION

1. Field of the Invention

The present invention relates to a power transfer device for an inboard/outboard motor.

2. Description of the Prior Art

Disclosed in Japanese Patent Laid-open Publication No. 4(1992)-143195 is a power transfer device for an inboard/outboard motor which includes a propeller unit mounted on the hull of a boat. The propeller unit comprises an input shaft for drive connection to the motor, an intermediate shaft in drive connection to a propeller shaft, a driven gear fixed to one end of the intermediate shaft and meshed with a pair of forward and backward gears rotatably assembled with the input shaft, and a pair of hydraulic clutches disposed between the input shaft and the forward gear and between the input shaft and the backward gear for selectively connecting the forward or backward gear to the input shaft.

When the power transfer device is shifted for forward drive, either one of the hydraulic clutches is engaged to drivingly connect the forward gear to the input shaft. While the other hydraulic clutch is maintained in a disengaged condition to permit free rotation of the backward gear on the input shaft. When the power transfer device is shifted for backward drive, the latter hydraulic clutch is engaged to drivingly connect the backward gear to the input shaft, while the former hydraulic clutch is disengaged to permit free rotation of the forward gear on the input shaft. Thus, the power transfer device is smoothly shifted for forward or backward drive. In the power transfer device, however, there occurs drag torque between the input shaft and the forward or backward gear when either one of the hydraulic clutches is maintained in a disengaged condition. This causes drag torque at the hydraulic clutch in a disengaged condition, resulting in loss of the drive torque and deterioration of the power transfer efficiency. As the drive torque is transmitted to the intermediate shaft from the input shaft through either one of the hydraulic clutches in each operation. It is required to provide the hydraulic clutches respectively in a large size for transmission of the drive torque. For this reason, the whole construction of the power transfer device becomes large in size.

SUMMARY OF THE INVENTION

It is, therefore, a primary object of the present invention to provide a power transfer device for an inboard/outboard motor capable of overcoming the problems discussed above.

According to the present invention, the object is attained by providing a power transfer device for an inboard/outboard motor, which comprises a propeller unit mounted on the hull of a vessel, the propeller unit including an input shaft for drive connection to an output shaft of the inboard/outboard motor, an intermediate shaft connected to a propeller shaft, a hydraulic clutch provided on the input shaft to establish a drive power train between the input shaft and intermediate shaft when it has been engaged and to disconnect the input shaft from the intermediate shaft when it has been disengaged, and a changeover mechanism of the gear selection type disposed between the input shaft and intermediate shaft for switching over the drive power train from a forward drive to a backward drive or vice versa, wherein the power transfer device is provided with a hydraulic control apparatus for operating the changeover mechanism in shifting operation to switch over the drive power train from the forward drive to the backward drive or vice versa in a condition where the hydraulic clutch is maintained in its disengaged condition and for engaging the hydraulic clutch after the drive power train has been switched over from the forward drive to the backward drive or vice versa.

BRIEF DESCRIPTION OF THE DRAWINGS

Other objects, features and advantages of the present invention will be more readily appreciated from the following detailed description of preferred embodiments thereof when taken together with the accompanying drawings, in which.

DESCRIPTION OF THE PREFERRED EMBODIMENT

Figure 1:
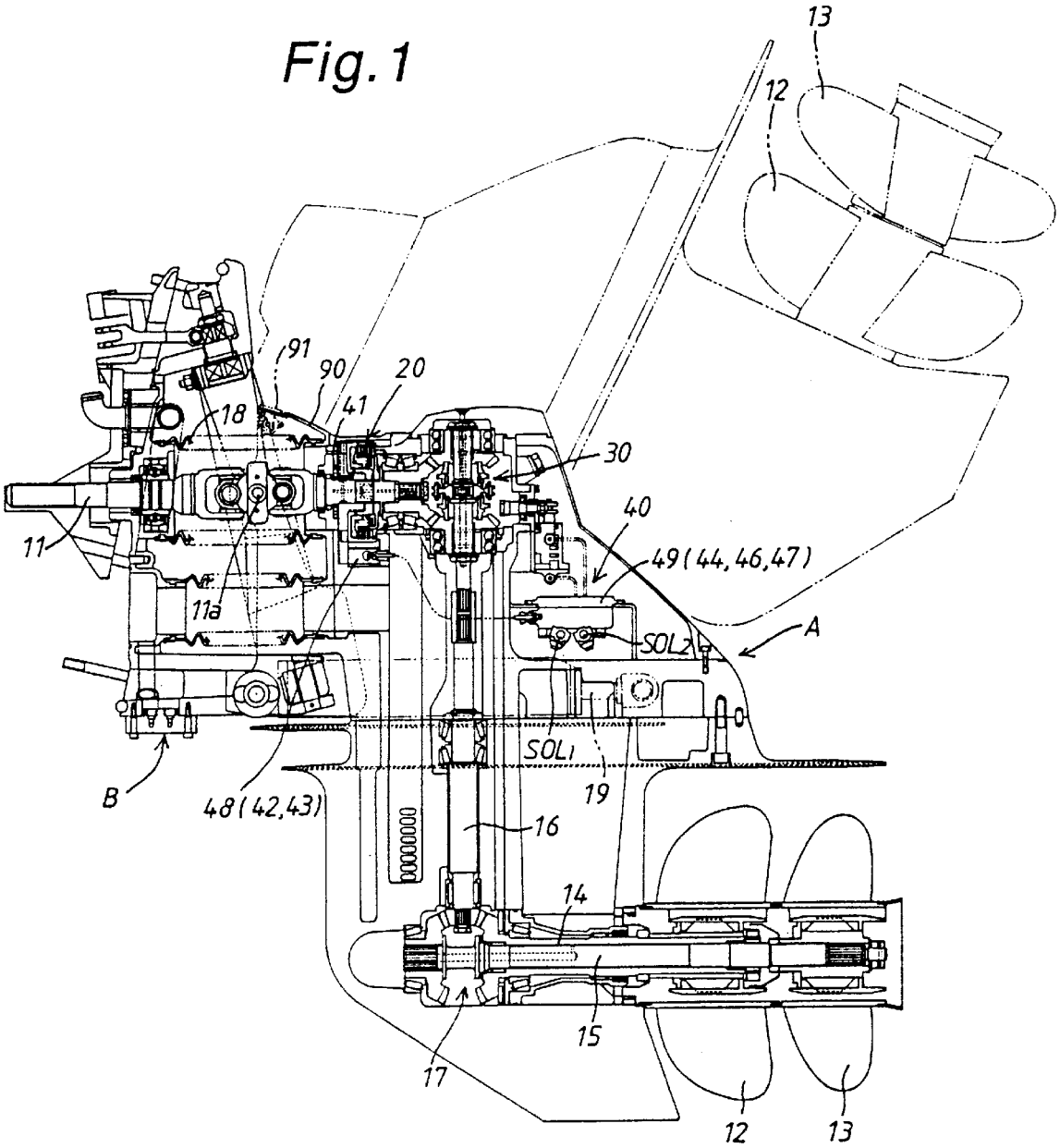
FIG. 1 is a vertical sectional view of a power transfer device for an inboard/outboard motor in accordance with the present invention.

Illustrated In FIG. 1 of the drawings is a power transfer device for an inboard motor mounted inside the hull of a vessel or watercraft (not shown), which includes a propeller unit A composed of an input shaft 11 for drive connection to an output shaft of the inboard motor, a pair of parallel propeller shafts 14 and 15 provided thereon with propellers 12 and 13 for rotation therewith, an intermediate shaft 16 connected to the input shaft 11 through a hydraulic multiplate clutch 20 and a changeover mechanism 30 for selectively establishing a forward or backward drive train, and a power distribution device 17 interposed between the intermediate shaft 16 and the propeller shafts 14, 15. The input shaft 11 is provided at an intermediate portion thereof with a universal joint 11*a* covered with a boot 18. The power distribution device 17 is composed of three bevel gears for distributing drive torque to the propeller shafts 14 and 15 from the intermediate shaft 16.

The propeller unit A is mounted on the stern of the watercraft by means of a support mechanism B in such a manner as to be tilted upward at the center of the universal joint 11*a* under operation of a hydraulic cylinder 19 as shown by imaginary lines in the figure. In a condition where the propeller unit A has been tilted upward, the propellers 12 and 13 are raised above the surface of water to facilitate repair and maintenance thereof.

Figure 2:
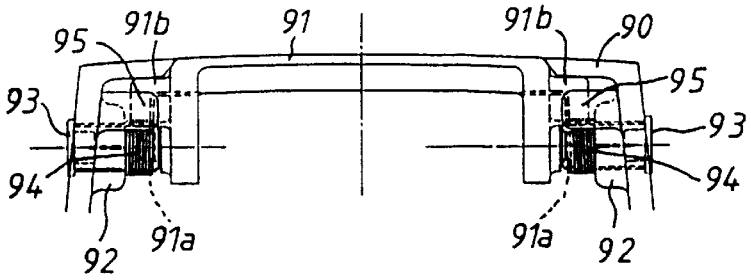
FIG. 2 is a front view of an upper portion of a housing of the power transfer device shown in FIG. 1.
Figure 3:
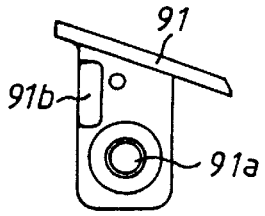
FIG. 3 is a side view of a cover portion shown in FIG. 2.
Figure 4:
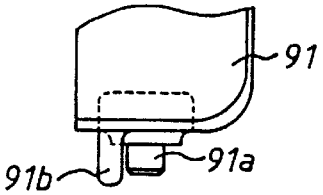
FIG. 4 is a plan view partly illustrating the cover portion shown in FIG. 2.
Figure 5:
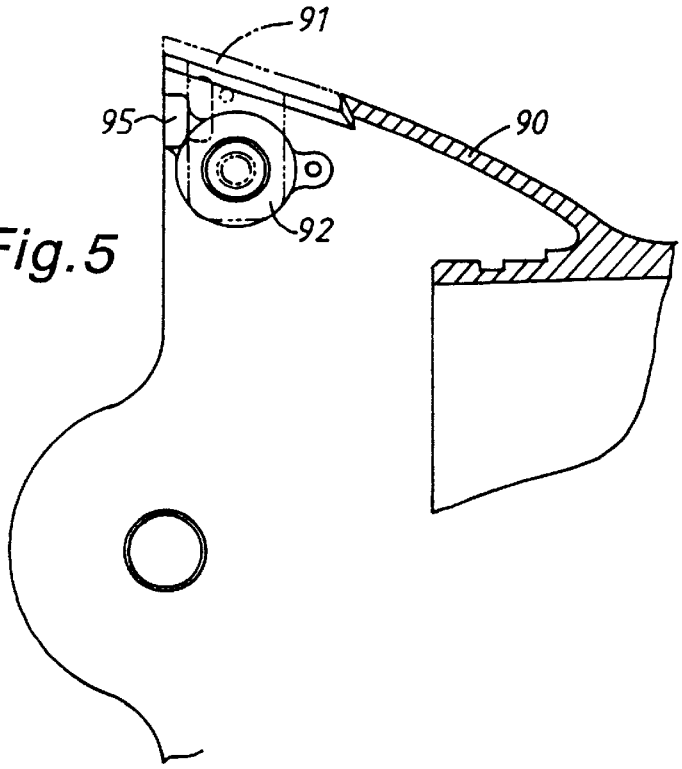
FIG. 5 is an enlarged sectional view of a support portion of the housing shown in FIG. 2.

When the propeller unit A is tilted up, a cover member 91 assembled with a housing 90 of the power transfer device is rotated by abutment against the boot 18 to avoid damage of the boot 18. As shown in FIGS. 2–4, the cover member 91 has a pair of laterally spaced leg portions each formed with a support pin 91*a*, and the housing 90 is integrally formed with a pair of laterally spaced carrier portions 92 which correspond with the support pins 91*a* of cover member 91. The support pins 91*a* are coupled within the carrier portions 92 of housing 90 and supported by a pair of retainer pins 93. A weak torsion spring 94 in surrounding relationship with each of the support pins 91*a* is engaged at one end thereof with the cover member 91 and at the other end thereof with the carrier portion 92 to bias the cover portion 91 downward. With the cover member 91 assembled with the housing 90 in such a manner as described above, the propeller unit A can be tilted upward at an angle more than 65 degrees. In addition, the housing 90 Is integrally formed with a pair of laterally spaced stoppers 95 as clearly shown in FIG. 5, and the cover member 91 is integrally formed at its leg portions with a pair of laterally spaced projections 91*b* as clearly shown in FIGS. 3 and 4. When the propeller unit A is tilted downward, the cover member 91 is positioned in place by engagement with the stoppers 95 of housing 90 at its projections 91*b*.

Figure 6:
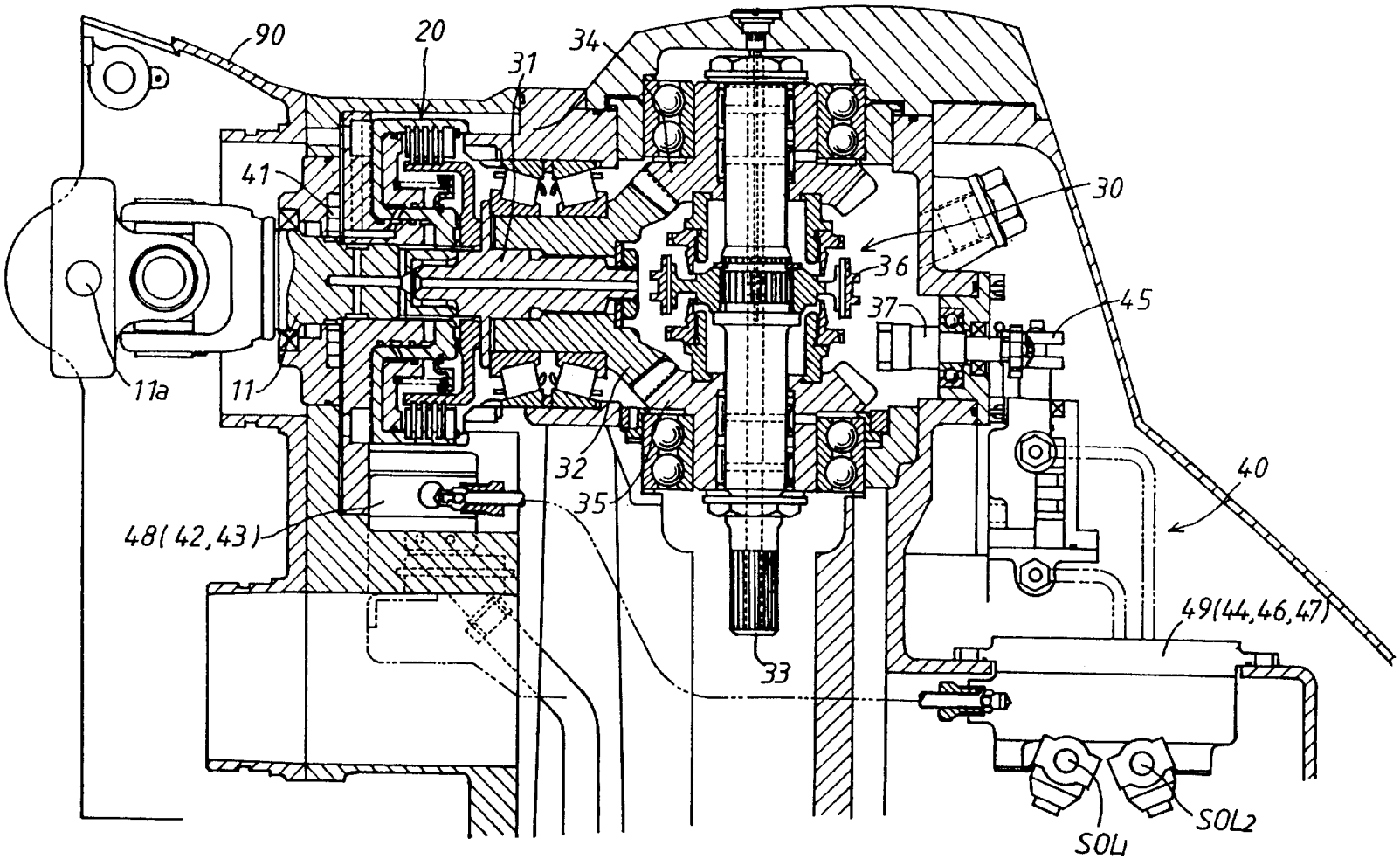
FIG. 6 is an enlarged sectional view of the power transfer device shown in FIG. 1.

As shown in FIGS. 1 and 6, the hydraulic multi-plate clutch 20 is provided on the input shaft 11 coaxially therewith to connect the input shaft 11 to a drive shaft 31 of the changeover mechanism 30 under control of a hydraulic control apparatus 40. Under control of the hydraulic control apparatus 40, the hydraulic clutch 20 is engaged by hydraulic fluid under pressure supplied thereto to connect the input shaft 11 to the drive shaft 31 and is disengaged by discharge of the hydraulic fluid under pressure therefrom to disconnect the drive shaft 31 from the input shaft 11.

The changeover mechanism 30 is disposed between the input shaft 11 and the intermediate shaft 16 to selectively establish a forward drive train or a backward drive train. The changeover mechanism 30 includes a drive bevel gear 32 rotatably mounted within the housing 90 through a set of tapered roller bearings and coupled with the drive shaft 31 for rotation therewith, a driven shaft 33 connected to the intermediate shaft 16 for rotation therewith, a pair of forward and backward bevel gears 34 and 35 rotatable mounted within the housing 90 respectively through a ball bearing to be freely rotatable on the driven shaft 33 and constantly meshed with the drive bevel gear 32, a shift sleeve 36 slidably mounted on the driven shaft 33 in a position between the bevel gears 34 and 35 to selectively connect the bevel gear 34 or 35 to the intermediate shaft 16 through a synchronizer under control of the hydraulic control apparatus 40.

Figure 7:
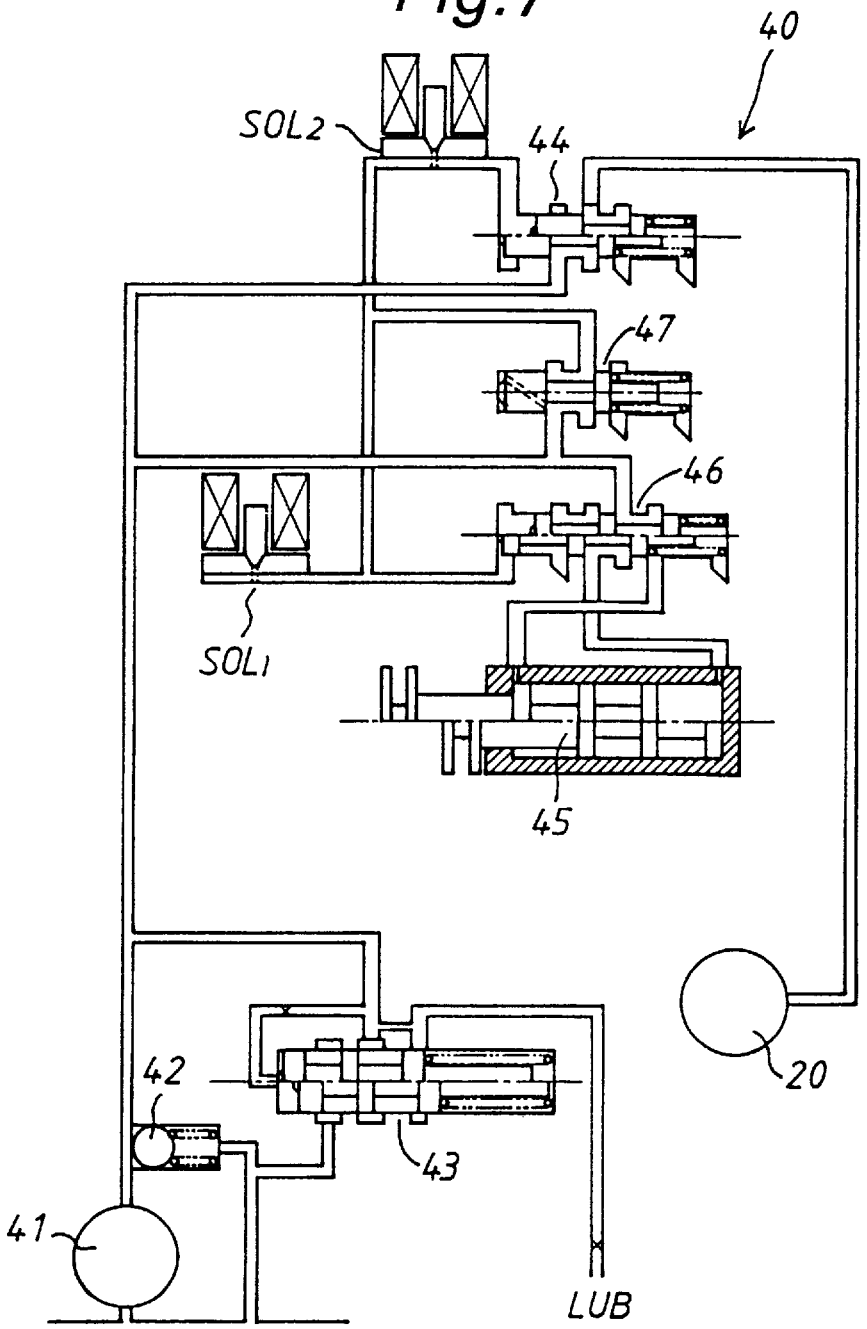
FIG. 7 is a hydraulic circuit of a control device for controlling each operation of a hydraulic clutch and a changeover mechanism for selectively establishing a forward or backward drive train in the power transfer device.

The hydraulic control apparatus 40 is provided to control each operation of the hydraulic clutch 20 and the changeover mechanism 30 in response to operation of a changeover switch (not shown) for selection of forward or backward drive. As shown in FIGS. 6 and 7, the hydraulic control apparatus 40 includes an oil pump 41 driven by the input shaft 11, a relief valve 42 for defining a maximum discharge pressure of oil pump 41, a regulator valve 43 for regulating the pressure of hydraulic fluid discharged from the oil pump 41 to a line pressure and for supplying a portion of the hydraulic fluid under pressure as lubricant to component parts of the propeller unit A to be lubricated, a clutch relay valve 44 for controlling hydraulic fluid under pressure supplied to the hydraulic clutch from the regulator valve therethrough, a solenoid valve SOL2 of the normally closed type for controlling operation of the clutch relay valve 44, a shift piston 45 for shifting the shift sleeve 36 of changeover mechanism 30 through a shift lever shaft 37 and a shift fork (not shown), a shift valve 46 for controlling operation of the shift piston 45. a solenoid valve SOL1 of the normally open type for controlling operation of the shift valve 46, and a modulator valve 47 for modulating the line pressure to a low pressure and supplying hydraulic fluid under the modulated low pressure to both the solenoid valves SOL1 and SOL2. As shown in FIG. 6, the relief valve 42 and regulator valve 43 are assembled within a front valve body 48, and the clutch relay valve 44, shift valve 46, modulator valve 47 and both the solenoid valves SOL1, SOL2 are assembled within a rear valve body 49.

In the hydraulic control apparatus 40, the solenoid valves SOL1, SOL2 each are turned on and off in response to operation of the changeover switch in the form of a shift switch (not shown) for selection of forward drive or backward drive. In a condition where the changeover switch is in a forward position for forward drive, both the solenoid valves SOL1 and SOL2 are maintained In their open positions, and the clutch relay valve 44 and shift valve 46 are maintained in a condition shown by a lower half in FIG. 7. In such a condition, the hydraulic clutch 20 is engaged by hydraulic fluid under line pressure supplied from the regulator valve 43 through the clutch relay valve 44, and the shift piston 45 is maintained in a condition shown by an upper half in FIG. 7 so that the shift sleeve 36 is maintained in an upper position in FIG. 6 to connect the bevel gear 34 for forward drive to the driven shaft 33.

In a condition where the changeover switch is in a backward position for backward drive, the solenoid valve SOL1 Is closed, the solenoid valve SOL2 is maintained in its open position, the clutch relay valve 44 is maintained in a condition shown by a lower half in FIG. 7, and the shift valve 46 is maintained in a condition shown by an upper half in FIG. 7. In such a condition, the hydraulic clutch 20 is engaged by hydraulic fluid under line pressure supplied from the regulator valve 43, and the shift piston 45 is maintained in a condition shown by a lower half in FIG. 7 so that the shirt sleeve 36 is placed in a lower position in FIG. 6 to connect the bevel gear 35 for backward drive to the driven shaft 33.

When the changeover switch is switched over from the forward position to the backward position or vice versa, the solenoid valve SOL1 is temporarily maintained in its open position while the solenoid valve SOL2 is maintained in its closed position. During such a transition period, the clutch relay valve 44 is placed in a condition shown by the upper half in FIG. 7 to disengage the hydraulic clutch 20, and the shift valve 46 is placed in a condition shown by the lower half in FIG. 7. After the transition period, the solenoid valve SOL2 is opened to engage the hydraulic clutch 20. In this instance, the solenoid valve SOL1 is closed when the changeover switch has been switched over from the forward position to the backward position and Is maintained in its open position when the changeover switch has been switched over from the backward position to the forward position. When the solenoid valve SOL2 is opened after the transition period while the solenoid valve SOL1 is closed, it is desirable that the time for switching over the hydraulic clutch 20 from its disengaged condition to its engaged condition is determined to be longer than the time for shifting the shift piston 45. For this reason, a throttle may be disposed in a fluid passage connecting the clutch relay valve 44 to the hydraulic clutch 20. In such a case, a check valve is disposed in a bypass passage (not shown) of the throttle to discharge the hydraulic fluid under pressure from the clutch 20.

From the above description, it will be understood that when the changeover switch is switched over from the forward position to the backward position or vice versa, the change-over mechanism 30 is switched over in a condition where the component parts between the hydraulic clutch 20 and the propeller shafts 14, 15 are maintained inoperative for the transition period during which the hydraulic clutch 20 is temporarily maintained in its disengaged condition under control of the hydraulic control apparatus 40. Under such control of the hydraulic control apparatus 40, the hydraulic clutch 20 Is engaged after the changeover mechanism 30 has been switched over so that the power transfer device is smoothly shifted to selectively establish the forward drive train or the backward drive train.

Although in the power transfer device described above, the hydraulic clutch 20 is temporarily maintained in its disengaged condition in shifting operation for the forward or backward drive, the clutch 20 is maintained in its engaged condition during the forward or backward drive to permit free rotation of either one of the bevel gears 34 and 35. This is useful to reduce loss of the drive torque and to enhance the power transmission efficiency. In addition, the power transfer device of the present invention can be provided in a small size with only the hydraulic clutch 20.

Figure 8A:
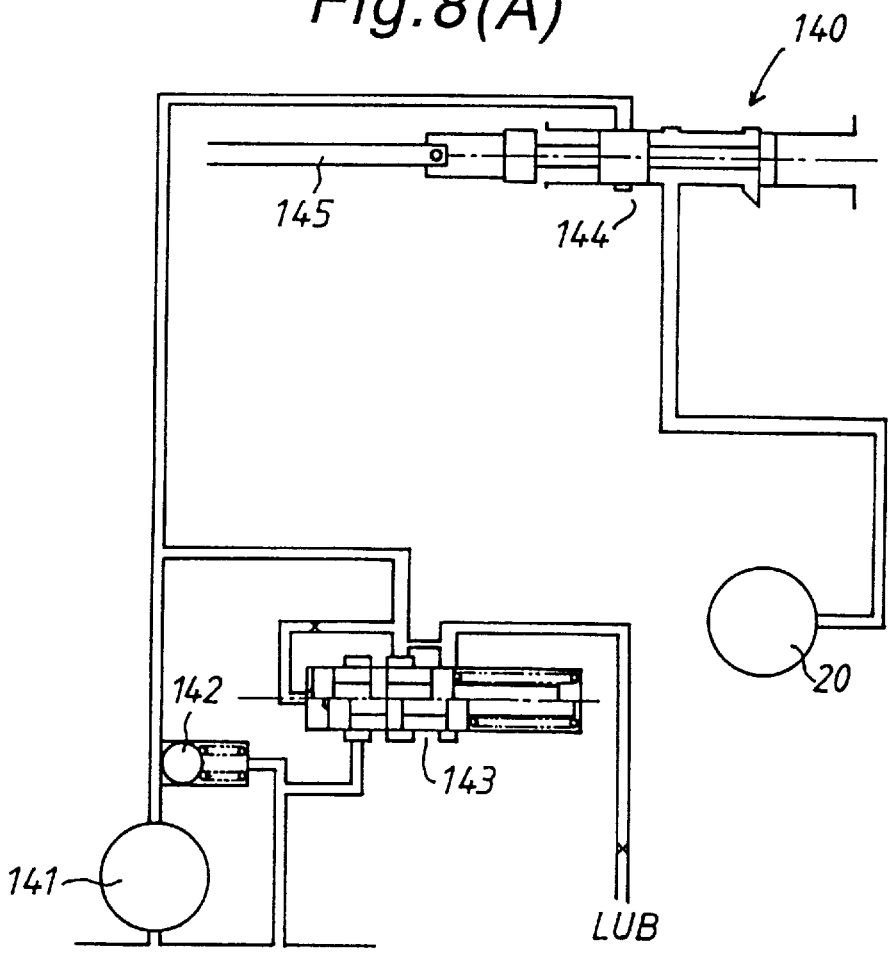
FIGS. 8(A)–8(C) illustrates a modification of the hydraulic control circuit shown in FIG. 7.

Although in the above embodiment, the changeover mechanism 30 has been constructed to be shifted by the shift piston 45 without using a linkage or a push-pull cable, the hydraulic control apparatus 40 for the hydraulic clutch 20 and changeover mechanism 30 may be modified as in a hydraulic control apparatus 140 shown In FIG. 8(A).

The hydraulic control apparatus shown in FIG. 8(A) includes an oil pump 141 driven by the input shaft 11, a relief valve 142 for defining a maximum discharge pressure of the oil pump 141, a regulator valve 143 for regulating the pressure of hydraulic fluid discharged from the oil pump 141 to a line pressure and supplying a portion of the hydraulic fluid as lubricant to component parts of the propeller unit A to be lubricated, a clutch relay valve 144 for switching over the line pressure applied to the hydraulic clutch 20, and a linkage 145 for operating the clutch relay valve 144. The linkage 145 is connected to a linkage or a push-pull cable for rotating the shift lever shaft 37 operatively connected to the shift sleeve 36 of changeover mechanism 30. The linkage or push-pull cable is connected to a shift lever (not shown) in a usual manner.

Figure 8B:
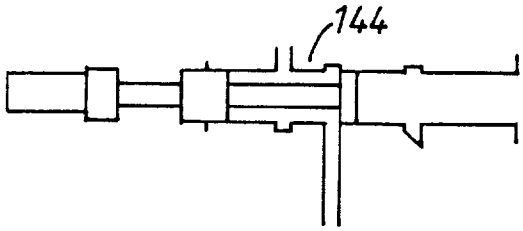
Figure 8C:
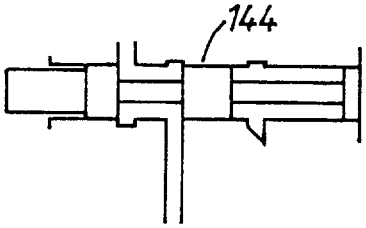

When the shift lever (not shown) is retained in a neutral position, the clutch relay valve 144 is retained in a position shown in FIG. 8(A) to maintain the hydraulic clutch 20 in its disengaged condition. When the shift lever is retained in a forward position, the clutch relay valve 144 is retained in a position shown in FIG. 8(B) to maintain the hydraulic clutch 20 in its engaged condition. When the shift lever is retained in a backward position, the clutch relay valve 144 is retained in a position shown in FIG. 8(C) to maintain the hydraulic clutch 20 in its engaged condition. Thus, the useful effects as well as in the above embodiment is obtainable in shifting operation of the shift lever from the forward position to the backward position or vice versa. Additionally, in a condition where the clutch relay valve 144 is retained in the position shown in FIG. 8(A) under control of the hydraulic control apparatus 140, the component parts between the hydraulic clutch 20 and propeller shafts 14, 15 are maintained inoperative during rotation of the input shaft 11.

Although in the above embodiment, the present invention has been adapted to the propeller unit A equipped with the pair of parallel propeller shafts 14 and 15, the present invention may be adapted to a propeller unit equipped with a single propeller shaft. Although in the above embodiment, the changeover mechanism 30 with synchronizers has been adapted to the power transfer device, another changeover mechanism of the gear selection type with a dog-clutch may be adapted to the power transfer device.

What is claimed is:

1. A power transfer device for an inboard/outboard motor, comprising a propeller unit mounted on a hull of a vessel, said propeller unit including an input shaft for drive connection to an output shaft of the inboard/outboard motor, a vertical intermediate shaft connected to a propeller shaft at its lower end, a hydraulic clutch mounted on the input shaft to establish a drive power train between the input shaft and the intermediate shaft upon engagement and to disconnect the input shaft from the intermediate shaft upon disengagement, and a gear selection type changeover mechanism disposed between the input shaft and the intermediate shaft for switching over the drive power train from a forward drive to a backward drive or vice versa, said changeover mechanism including a drive shaft located coaxially with the input shaft to be connected to the input shaft through said hydraulic clutch, a drive bevel gear coupled with the drive shaft for rotation therewith, a driven shaft connected to an upper end of the intermediate shaft for rotation therewith and a pair of bevel gears rotatably mounted on the driven shaft and meshed with the drive bevel gear.

2. A power transfer device for an inboard/outboard motor as recited in claim 1, including a hydraulic control apparatus for said hydraulic clutch and said changeover mechanism that includes a hydraulic fluid pump driven by said input shaft, a regulator valve for regulating the pressure of hydraulic fluid discharged from said fluid pump to a predetermined line pressure, an electrically operated clutch relay valve for permitting hydraulic fluid under the line pressure supplied to said hydraulic clutch from said regulator valve therethrough when the clutch relay valve is retained in a first position and for interrupting the hydraulic fluid under the line pressure supplied to said hydraulic clutch when the clutch relay valve is retained in a second position, and control means for maintaining said clutch relay valve in the second position for a predetermined transition period when said changeover mechanism is operated to switch over the drive power train from the forward drive to the backward drive or vice versa and for switching over said clutch relay valve from the second position to the first position after the drive power train has been switched over from the forward drive to the backward drive or vice versa.

3. A power transfer device for an inboard/outboard motor as recited in claim 1, wherein said hydraulic clutch is in the form of a hydraulic multi-plate clutch.

* * * * *